US008499509B2

(12) United States Patent
Sibbett

(10) Patent No.: US 8,499,509 B2
(45) Date of Patent: Aug. 6, 2013

(54) JAMB ASSEMBLY FOR DOOR

(75) Inventor: Peter Yong Sibbett, Tacoma, WA (US)

(73) Assignee: Capstone Engineering Co., Ltd. (KR)

( * ) Notice: Subject to any disclaimer, the term of this patent is extended or adjusted under 35 U.S.C. 154(b) by 188 days.

(21) Appl. No.: 13/087,766

(22) Filed: Apr. 15, 2011

(65) Prior Publication Data

US 2012/0137605 A1 Jun. 7, 2012

(30) Foreign Application Priority Data

Dec. 2, 2010 (KR) ..... 10-2010-0122015

(51) Int. Cl.
*E06B 1/30* (2006.01)
*E06B 1/32* (2006.01)
*E06B 1/52* (2006.01)

(52) U.S. Cl.
USPC ..... 52/211; 52/204.1; 52/313; 52/717.01; 49/504; 49/DIG. 2

(58) Field of Classification Search
USPC ..... 52/204.1, 211, 309.8, 313, 656.4, 52/717.01, 717.04, 836, 847; 49/504, DIG. 2
See application file for complete search history.

(56) References Cited

U.S. PATENT DOCUMENTS

| | | | | |
|---|---|---|---|---|
| 2,639,472 | A * | 5/1953 | Jonsson | 52/211 |
| 3,815,285 | A * | 6/1974 | Kuyper | 49/501 |
| 6,125,605 | A * | 10/2000 | Young | 52/717.01 |
| 6,295,779 | B1 * | 10/2001 | Canfield | 52/656.4 |
| 6,347,494 | B1 * | 2/2002 | Noirot | 52/309.4 |
| 6,453,631 | B1 * | 9/2002 | Headrick | 52/210 |
| 6,604,334 | B2 * | 8/2003 | Rochman | 52/717.01 |
| 6,631,595 | B1 * | 10/2003 | Minter | 52/212 |
| 6,931,803 | B1 * | 8/2005 | Davis et al. | 52/251 |
| 2001/0051243 | A1 * | 12/2001 | Godavarti et al. | 428/36.9 |
| 2005/0257455 | A1 * | 11/2005 | Fagan | 52/210 |
| 2006/0096191 | A1 * | 5/2006 | Liu | 52/204.1 |
| 2009/0255197 | A1 * | 10/2009 | Chapman | 52/210 |
| 2010/0251642 | A1 * | 10/2010 | Erickson | 52/204.1 |
| 2011/0138714 | A1 * | 6/2011 | Van Seters | 52/204.5 |

FOREIGN PATENT DOCUMENTS

| | | | |
|---|---|---|---|
| GB | 2 197 015 | * | 5/1988 |
| WO | 95/05519 | * | 2/1995 |

* cited by examiner

*Primary Examiner* — Robert J Canfield
(74) *Attorney, Agent, or Firm* — Harness, Dickey & Pierce, P.L.C.

(57) ABSTRACT

Disclosed is a jamb assembly for a door having a novel structure, capable of representing a wooden feel and reinforcing the strength for a specific region by improving the structure of the jamb assembly coupled with an opening of a wall surface for the installation of the door. The jamb assembly is installed along an inner peripheral surface of an opening of a wall surface for installation of a door and constituting a door frame. The jamb assembly includes an outer skin section constituting an outer portion of the jamb assembly and having a surface molded with various patterns such as a wooden pattern, and a body core section surrounded by the outer skin section, constituting an inner frame portion of the jamb assembly, and fixedly coupled with the opening of the wall surface for the installation of the door.

7 Claims, 7 Drawing Sheets

JAMB ASSEMBLY FOR DOOR

CROSS REFERENCE TO RELATED APPLICATIONS

This application claims the benefit and priority of Korean Patent Application No. 2010-0122015 filed Dec. 2, 2010. The entire disclosure of the above application is incorporated herein by reference.

BACKGROUND OF THE INVENTION

1. Field of the Invention

The present invention relates to a jamb assembly for a door. More particularly, the present invention relates to a jamb assembly for a door having a novel structure, capable of representing a wooden feel and reinforcing the strength for a specific region by improving the structure of the jamb assembly coupled with an opening of a wall surface for the installation of the door.

2. Description of the Related Art

In general, a jab assembly for a door refers to a set of components constituting a typical door frame.

The door jamb assembly is made of wood or a metallic material, and fixedly installed along an inner peripheral portion of an opening of a wall surface for a door.

However, since the wooden jamb assembly has a weak strength, the wooden jamb assembly may be easily damaged.

In particular, a jamb assembly may be coupled with a door through a hinge. If the coupling portion of the jamb assembly has a weak strength, the coupling portion of the jamb assembly can be damaged. Accordingly, a preferable strength can be ensured in the coupling portion of the jamb assembly.

In addition, when taking into consideration damages such as the deformation of the jamb assembly caused by the shock occurring in the process of opening or closing the door, sufficient strength must be ensured in a remaining portion of the jamb assembly as well as the coupling portion thereof as described above.

Therefore, recently, the jamb assembly is made of a metallic assembly. However, since the outer appearance of the metallic jamb assembly is monotonous, a wooden pattern sheet is attached to the surface of the metallic jamb assembly.

However, if the adhesive property of the sheet is degraded due to the long use, the sheet may be detached from the jamb assembly, so that an esthetic sense may be degraded. In addition, the sheet may be torn due to scratches.

SUMMARY OF THE INVENTION

Accordingly, the present invention has been made to solve the above-mentioned problems occurring in the prior art, and the present invention provides a jamb assembly for a door having a novel structure, capable of sufficiently ensuring the whole strength, preventing esthetic sense of an outer appearance from being degraded due to scratches or long use, and minimizing the whole weight.

According to the present invention, there is provided a jamb assembly installed along an inner peripheral surface of an opening of a wall surface for installation of a door and constituting a door frame. The jamb assembly includes an outer skin section constituting an outer portion of the jamb assembly and having a surface molded with various patterns such as a wooden pattern, and a body core section surrounded by the outer skin section, constituting an inner frame portion of the jamb assembly, and fixedly coupled with the opening of the wall surface for the installation of the door.

The body core section is extrusion-molded by using polyvinyl Chloride or acrylonitrile Butadiene Styrene copolymer.

The body core section includes a fire-resisting product including ceramic wool.

The body core section includes a surface having a plurality of concavo-convex patterns in opposition to the inner peripheral surface of the opening of the wall surface for the installation of the door.

The outer skin section includes one selected from the group consisting of sheet molding compound, bulk molding compound, and thermoplastic resin.

The jamb assembly further includes a support core section interposed between the outer skin section and the body core section and including a thin metallic plate to reinforce strength of the body core section.

The support core section includes an iron material or a thin aluminum plate and is curved to cover a portion of the surface of the body core section surrounded by the outer skin section.

The jamb assembly includes a first jamb assembly coupled with a hinge, a second jamb assembly facing the first jamb assembly and coupled with a door lock, and a third jamb assembly coupling top ends of the first and second jamb assemblies to each other and forming a top surface of a door frame. The outer skin section of the first jamb assembly is provided on a surface thereof with a groove coupled with the hinge. The outer skin section of the third jamb assembly is provided on a surface thereof with a coupling hole coupled with the hinge.

ADVANTAGEOUS EFFECTS

As described above, the jamb assembly according to the present invention constitutes a door frame in the opening of the wall surface, and is provided therein with a body core obtained through an extrusion-molding process. Accordingly, the whole weight of the jamb assembly can be reduced, and the manufacturing cost can be reduced.

In addition, a support core can reinforce the strength insufficient due to the use of an extrusion-molded product, thereby preventing the whole strength from being degraded.

In particular, different from the conventional jamb assembly including a single material (e.g., wood or iron), the manufacturing coat and the whole weight can be reduced, and the esthetic sense for the outer appearance can be improved. In addition, even if the jamb assembly is used for a long time, problems such as discoloration or tearing cannot be prevented.

DETAILED DESCRIPTION OF THE EXEMPLARY EMBODIMENTS

Hereinafter, exemplary embodiments of a jamb assembly for a door according to the present invention will be described with reference to FIGS. 1 to 7.

Figure 1:
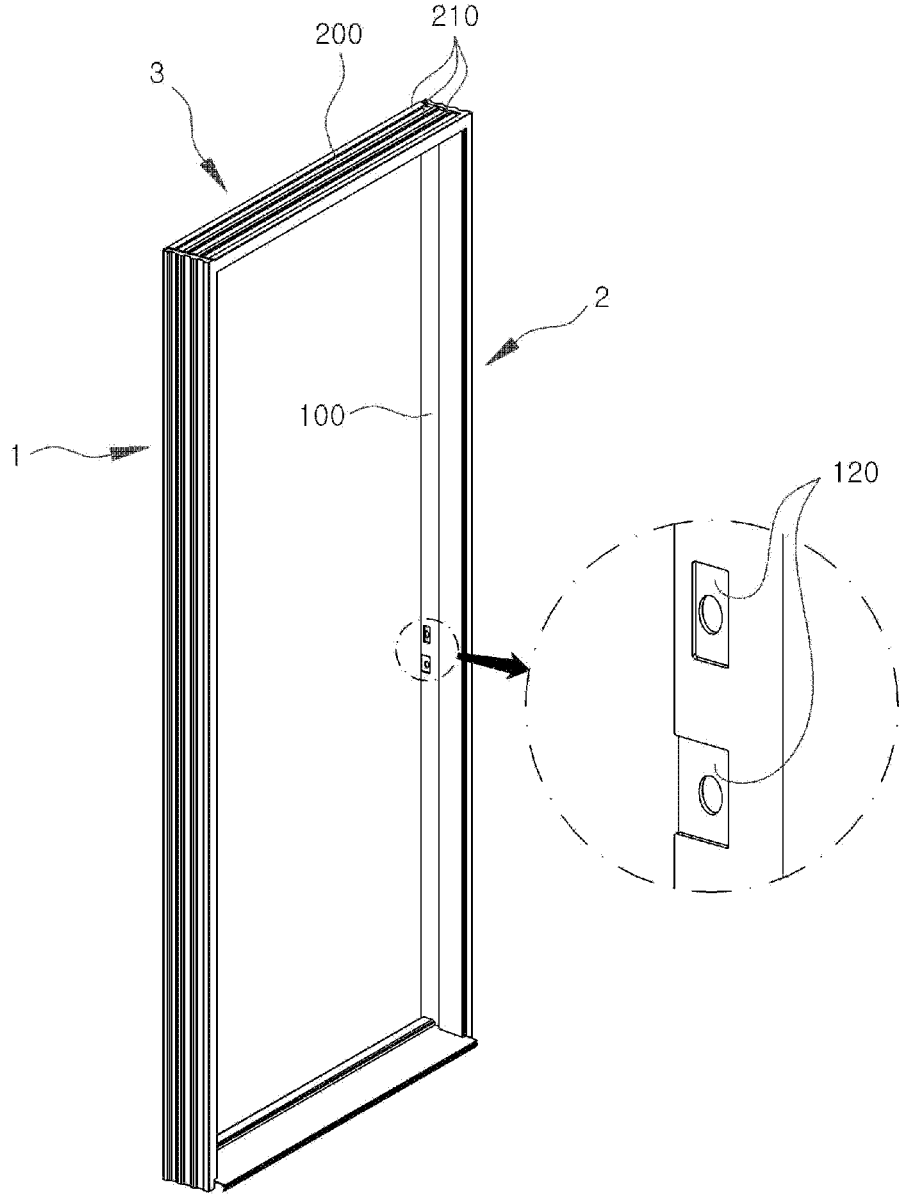
FIG. 1 is a perspective view showing a door frame formed by using jamb assemblies for a door according to an exemplary embodiment of the present invention.

As shown in FIG. 1, the jamb assembly for the door according to the present invention is classified into a jamb assembly 1 coupled with a hinge, a jamb assembly 2 facing the first jamb assembly 1 and coupling with a door lock, and a jamb assembly 3 coupling top ends of the two jamb assemblies 1 and 2 to each other and constituting a top surface of a door frame. A jamb assembly to be described later includes the three types of jamb assemblies 1, 2, and 3, and the jamb assembly 1 coupled with a hinge will be representatively described. Other jamb assemblies (e.g., jamb assembly coupled with a door lock) will be separately described with reference to accompanying drawings.

Figure 2:
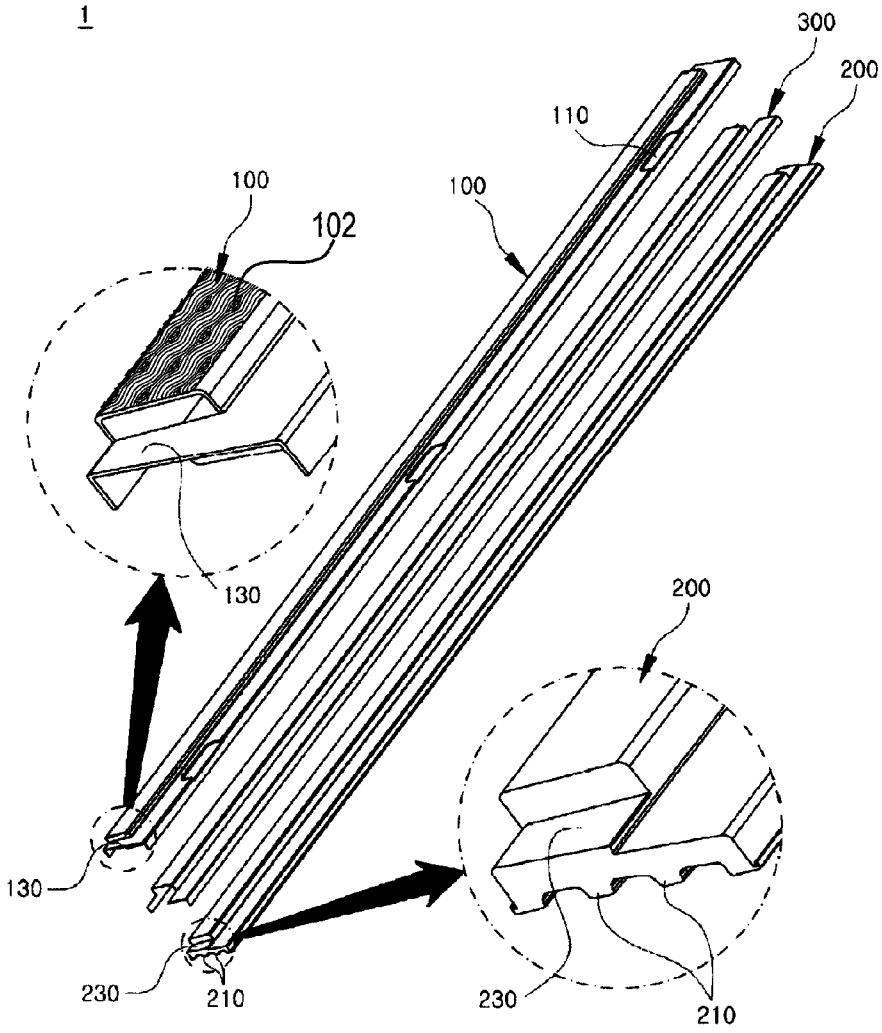
FIG. 2 is an exploded perspective showing a jamb assembly for a door according to an exemplary embodiment of the present invention.
Figure 3:
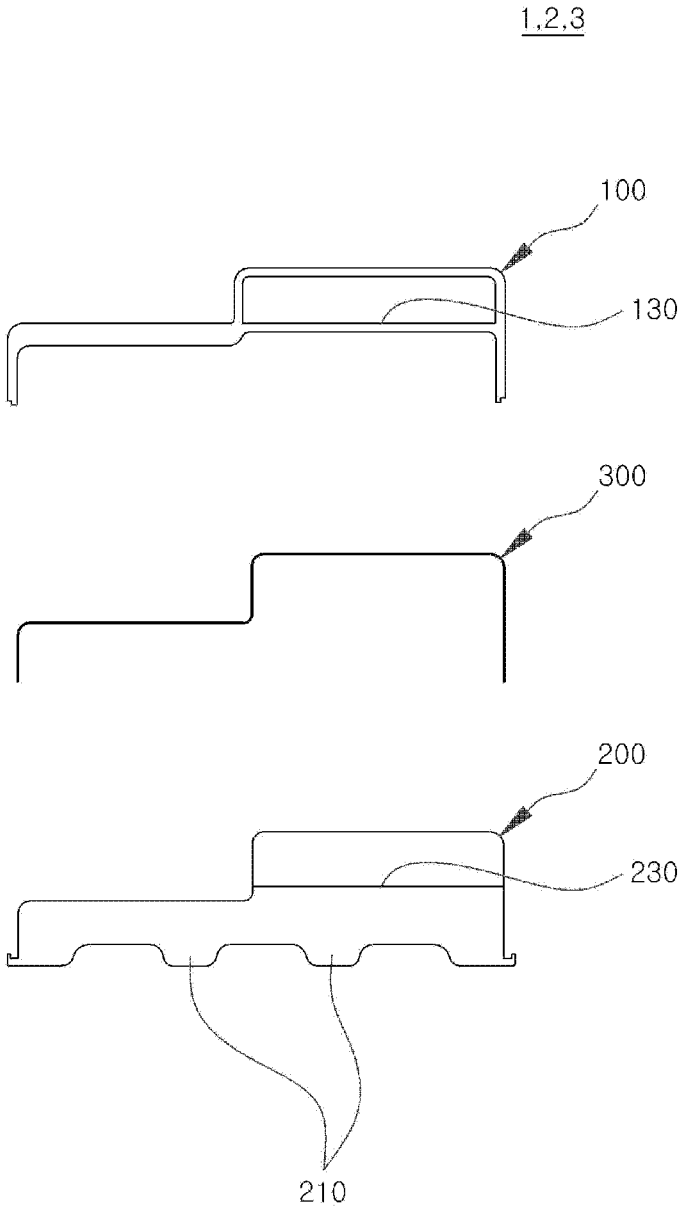
FIG. 3 is an exploded view showing end portions of jamb assemblies for a door according to an exemplary embodiment of the present invention.
Figure 4:
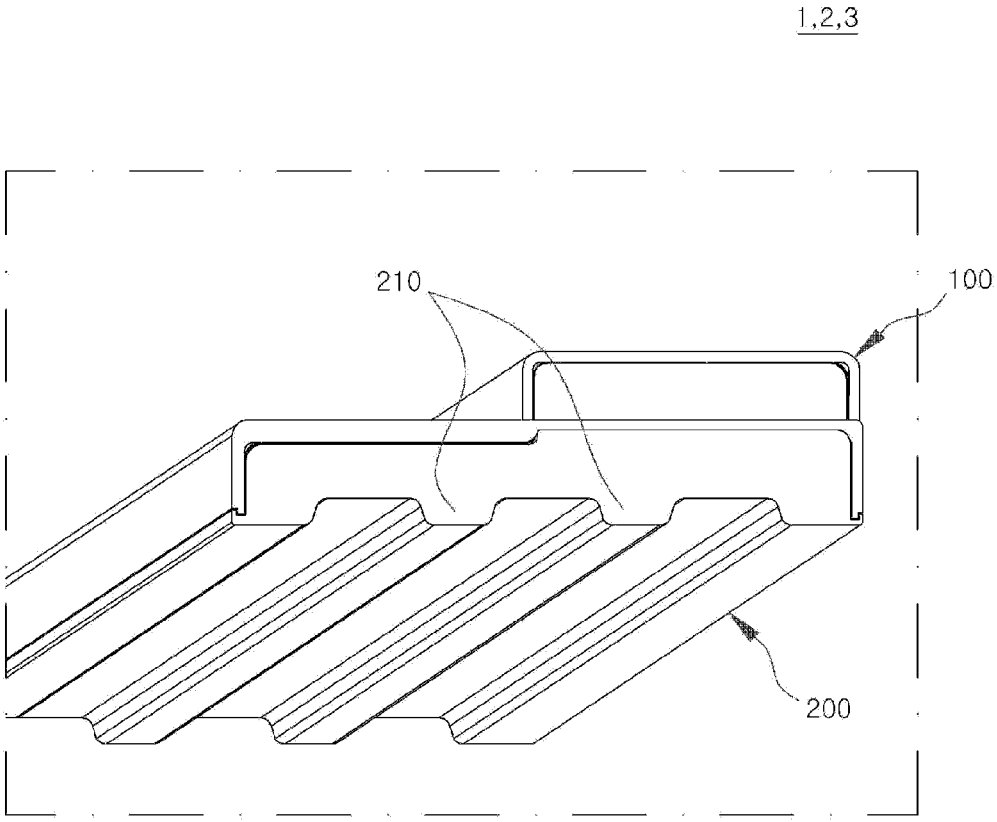
FIG. 4 is a perspective view showing main components constituting the jamb assembly for the door according to an exemplary embodiment of the present invention.
Figure 5:
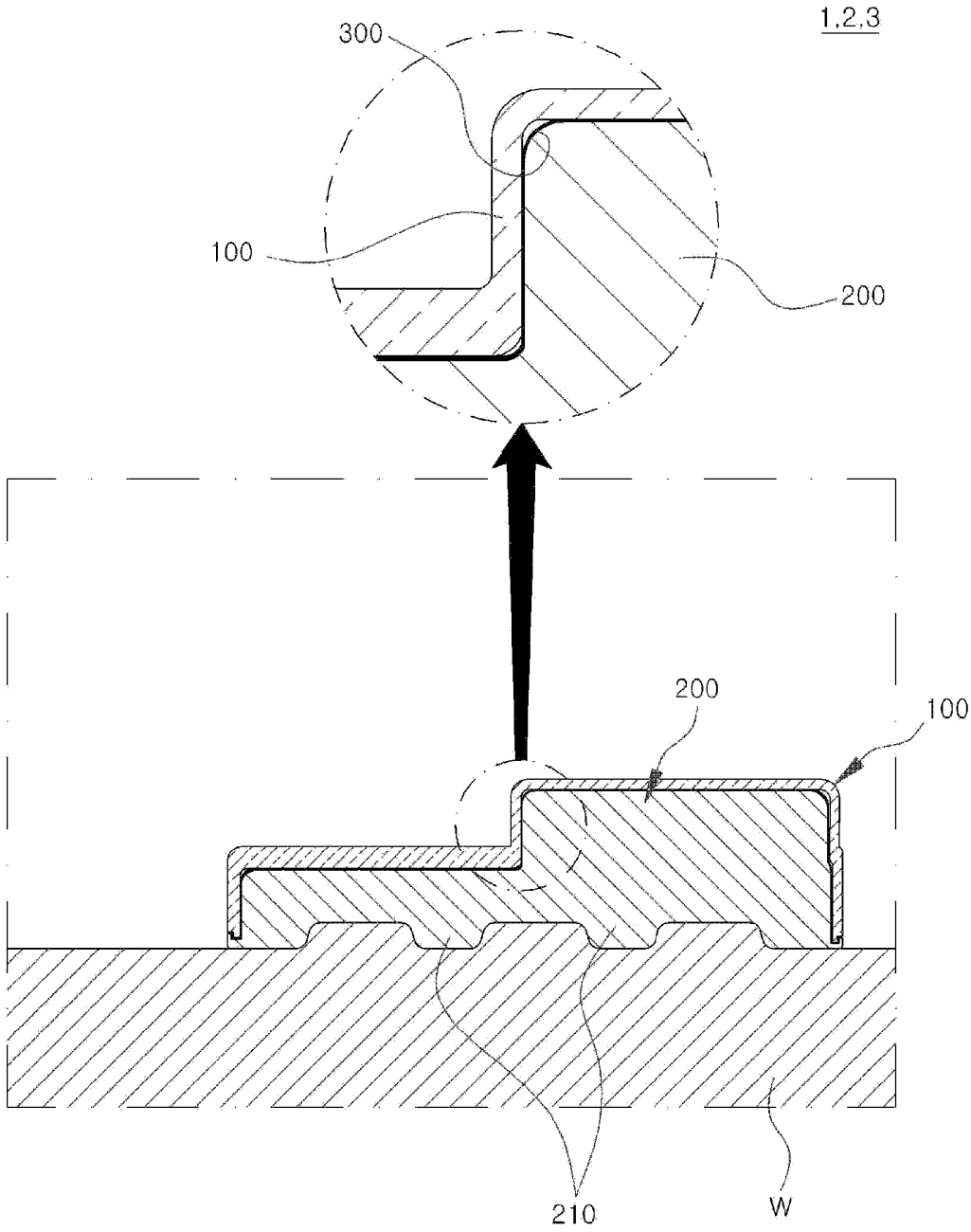
FIG. 5 is a sectional view showing the jamb assembly for the door mounted on a wall surface according to an exemplary embodiment of the present invention.

FIG. 2 shows a jamb assembly for a door according to an exemplary embodiment of the present invention. As shown in FIG. 2, the jamb assembly 1 for the door includes an outer skin section 100, a body core section 200, and a support core section 300.

In other words, different from the conventional jamb assembly including only one material, the jamb assembly according to the embodiment of the present invention includes three materials different from each other, thereby reducing the whole weight and representing wooden texture. Accordingly, an esthetic sense can be improved, and a desired strength can be ensured.

Hereinafter, the components of the jamb assembly will be described in more detail.

The outer skin section 100 constitutes an outer portion (the exposed outer surface) of the jamb assembly 1.

According to the embodiment of the present invention, the outer skin section 100 is molded with various patterns such as a wooden pattern 102.

In particular, the outer skin section 100 may include one selected from the group consisting of SMC (Sheet Molding Compound), BMC (Bulk Molding Compound) and thermoplastic resin.

The materials are stronger than wood, and enable the expression of wooden colors or wooden patterns.

In this case, in order to express a wooden pattern on the outer skin section 100, after etching the surface of a mold at the wooden pattern, the outer skin section 100 is molded by using the mold having the wooden pattern.

In other words, the outer skin section 100 of the jamb assembly 1 according to the embodiment of the present invention is not attached to an additional sheet having a wooden pattern, but molded with wooden feel color and pattern. Accordingly, the outer skin section 100 can be prevented from being discolored and delaminated due to a long use or stripped due to scratches.

Figure 6:
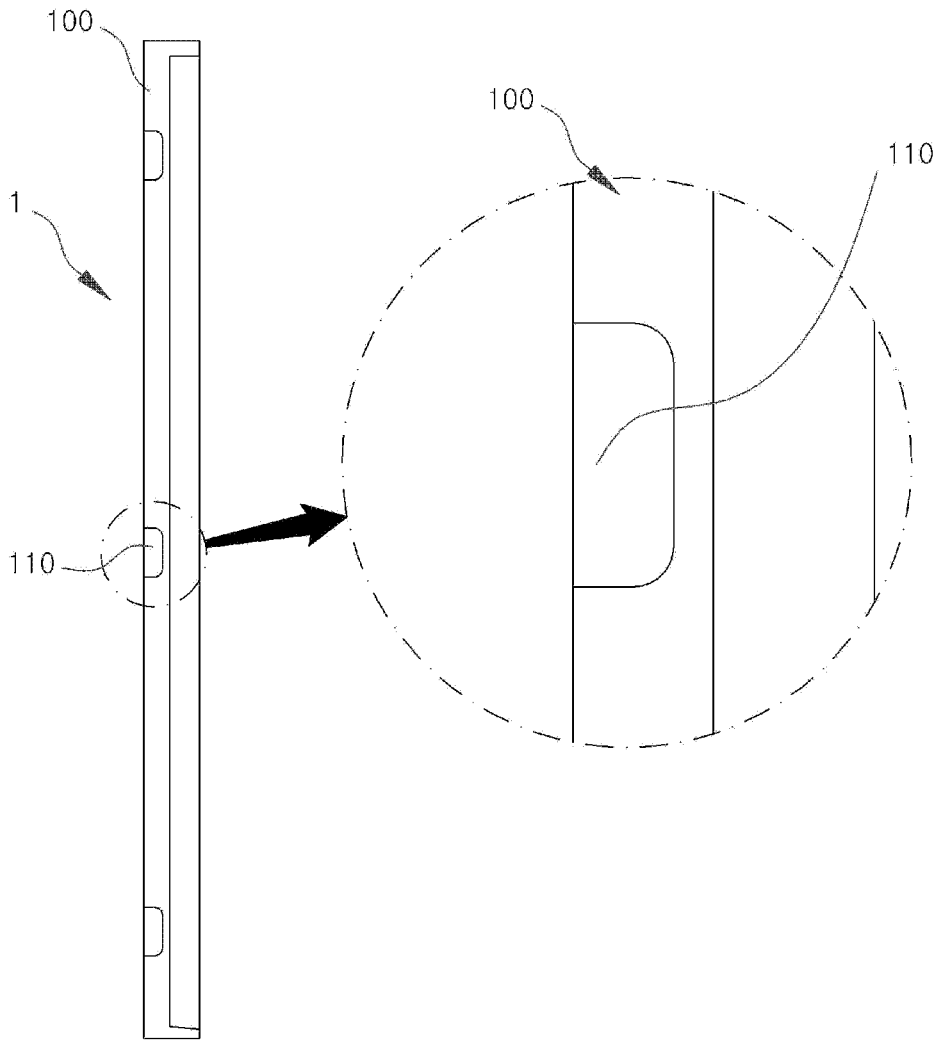
FIG. 6 is a front view showing a jamb assembly coupled with a hinge among jamb assemblies for the door according to the exemplary embodiment of the present invention.

In addition, as shown in FIGS. 2 and 6, the outer skin section 100 of the jamb assembly 1 coupled with a hinge is provided therein with a plurality of grooves 110 having the form of a step so that one end of the hinge is coupled with the groove 110. The outer skin section 100 of the jamb assembly 2 for installing of a door lock is provided therein with a through hole 120 as shown in FIGS. 1 and 7 so that the door lock is coupled with the through hole 120.

Figure 7:
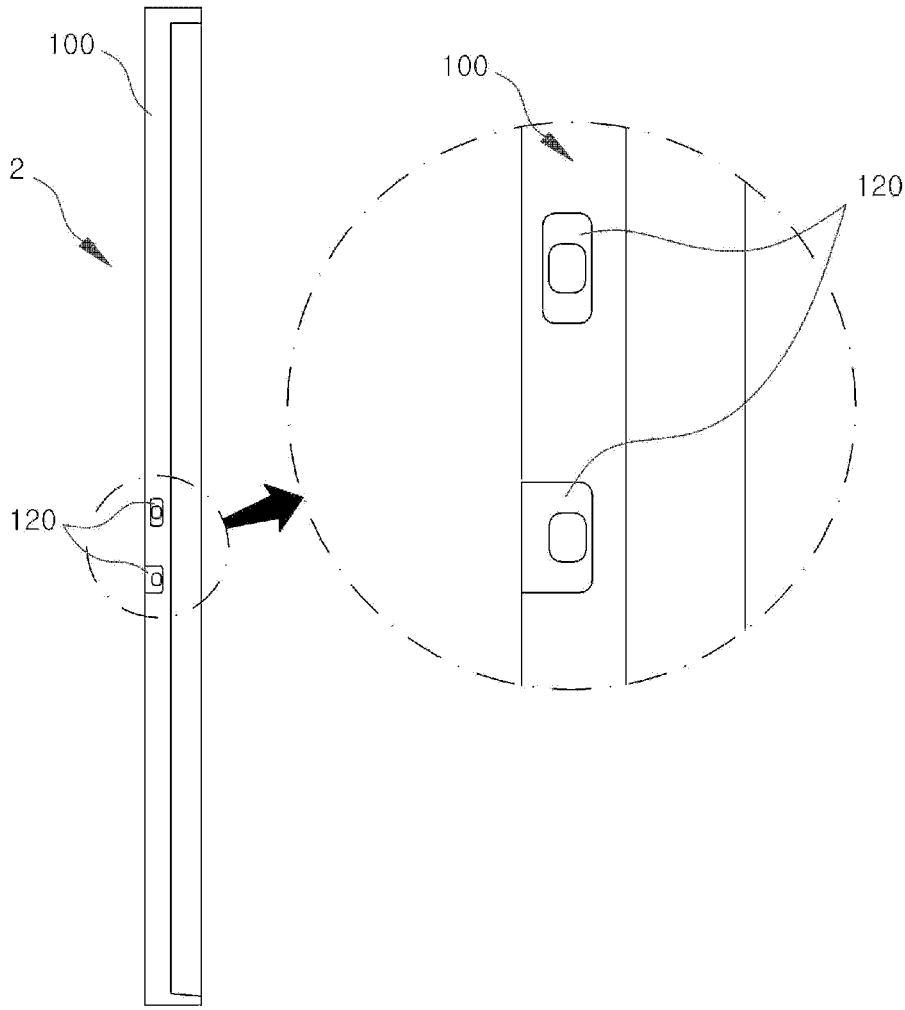
FIG. 7 is a front view showing a jamb assembly coupled with a door lock among the jamb assemblies for the door according to the exemplary embodiment of the present invention.

In this case, as shown in FIGS. 1 and 7, two coupling holes 120 may be provided. Although not shown, one coupling hole 120 may be provided. The number of the coupling holes 120 is determined according to the type of the door lock.

In contrast, the jamb assembly 3 constituting the top surface of the door frame is not provided therein with the groove 110 or the coupling hole 120.

Next, the body core section 200 constitutes an inner frame of the jamb assembly is fixed onto the inner peripheral surface W (see FIG. 5) of the opening of the wall surface for the door.

The body core section 200 is surrounded by the outer skin section 100 and constitutes the inner frame of the outer skin section 100. The body core section 200 has an outer appearance corresponding to an inner appearance of the outer skin section 100.

In addition, the embodiment of the present invention suggests that the body core section 200 is extrusion-molded by using PVC (Polyvinyl Chloride) or (Acrylonitrile Butadiene Styrene copolymer).

In other words, according to the embodiment of the present invention, the body core section 200 reduces the manufacturing cost and the whole weight of the jamb assembly 1. When comparing with a case of metal or wood, the manufacturing cost and the weight can be significantly reduced while the whole frame structure is being maintained.

If the door is manufactured as a fire-resting door, the body core section 200 preferably includes ceramic wool or vermiculite.

In addition, the body core section 200 has a surface facing the internal peripheral surface W of the opening of the wall surface for the door and provided therein with a plurality of concavo-convex patterns 210.

In this case, the concavo-convex patterns 210 increase the contact area with the internal peripheral surface W of the opening of the wall surface, thereby more enhancing the endurance in the coupling with the internal peripheral surface W. In addition, the concavo-convex patterns 210 prevent undesired movement in the close or open direction of the door.

Next, the support core section 300 reinforces the strength of the body core section 200.

In detail, since the body core section 200 includes an extrusion-molding material to reduce the manufacturing cost and the weight thereof, the body core section 200 has a weak strength. In order to complement the disadvantage of the body core section 200, the support core section 300 is additionally provided.

The support core section 300 has the form of a thin plate, includes a metallic material, and is interposed between the outer skin section 100 and the body core section 200 to minimize the whole weight. In addition, since the support core section 300 includes a metallic material, the support core section 300 can be stronger against the deformation of the jamb assembly such as the twist, or the vertical load or the horizontal load supplied from the door.

In this case, the support core section 300 has curved surfaces having the shapes identical to the shapes of facing surfaces of the body core section 200 and the outer core section 100, so that the support core section 300 closely makes contact with the inner surface of the outer section 100 and the outer surface of the body core section 200.

In addition, the support core section 300 may include an aluminum material as well as an iron material, so that the weight of the support core section 300 can be more reduced.

Meanwhile, the jamb assembly for the door according to the exemplary embodiment of the present invention includes step sections 130 and 230 formed at both ends of the outer skin section 100 and at both ends of the body core section 200.

The step sections 130 and 230 prevent the body core section 200 coupled with the outer skin section 100 from protruding out of both ends of the outer skin section 100, so that the body core section 200 is always installed at a right position. Accordingly, the step sections 130 and 230 are formed by bending portions of both ends of the outer skin section 100 and bending appropriate portions of the body core section 200.

The jamb assembly for a door having the above structures according to the embodiment of the present invention is assembled by covering the assembly of the support core section 300 and the body core section 200 by using the outer skin section 100 in a state that the support core section 300 covers the outer surface of the body core section 200.

In this case, the body core section 200 and the support core section 300, or the supper core section 300 and the outer skin section 100 are fixed to each other by using screws. In addition, the fixing may be performed through an adhesive. If an adhesive is used, screw exposure cannot be prevented.

In addition, the jamb assembly for a door according to the embodiment of the present invention is bonded to the inner peripheral surface W of the opening of the wall surface for the door by using cement, silicon, or an adhesive. The jamb assembly may be coupled with the wall surface W by using a bolt or a nail. However, if the bolt or the nail is used, a portion of the bolt or the nail is exposed to the outside, so that esthetic sense may be degraded. Accordingly, an additional finish work is required.

Therefore, the jamb assembly having the above structure according to the present invention is installed along the inner peripheral surface W of the opening of the wall surface to constitute a door frame. In addition, a wooden texture identical to that of the door can be expressed due to the outer skin section 100. The body core section 299, which is extrusion-molded, is installed inside the outer skin section 100, so that the whole weight and the manufacturing cost can be reduced. The shortage of the strength resulting from the use of the extrusion-molded product can be reinforced by using the support core section 300.

Therefore, different from the conventional jamb assembly including a single material (e.g., wood or iron), the manufacturing coat and the whole weight can be reduced, and the esthetic sense can be improved. In addition, even if the jamb assembly is used for a long time, problems such as discoloration or tearing cannot be prevented.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A jamb assembly installed along an inner peripheral surface of an opening of a wall surface for installation of a door and constituting a door frame, the jamb assembly comprising:

an outer skin section constituting an outer portion of the jamb assembly and having a surface molded with a wooden pattern;

a body core section covered by the outer skin section, constituting an inner frame portion of the jamb assembly, and fixedly coupled with the opening of the wall surface for the installation of the door; and a support core section interposed between the outer skin section and the body core section and including a thin metallic plate to reinforce strength of the body core section.

2. The jamb assembly of claim 1, wherein the body core section includes a surface having a plurality of concavo-convex patterns in opposition to the inner peripheral surface of the opening of the wall surface for the installation of the door.

3. The jamb assembly of claim 2, wherein the body core section is extrusion-molded by using polyvinyl Chloride or acrylonitrile Butadiene Styrene copolymer.

4. The jamb assembly of claim 2, wherein the body core section includes a fire-resisting product including ceramic wool.

5. The jamb assembly of claim 1, wherein the outer skin section includes one selected from the group consisting of sheet molding compound, bulk molding compound, and thermoplastic resin.

6. The jamb assembly of claim 1, wherein the support core section includes an iron material or a thin aluminum plate and is curved to cover a portion of the surface of the body core section surrounded by the outer skin section.

7. The jamb assembly of claim 1, wherein the jamb assembly includes a first jamb assembly coupled with a hinge, a second jamb assembly facing the first jamb assembly and coupled with a door lock, and a third jamb assembly coupling top ends of the first and second jamb assemblies to each other and forming a top surface of a door frame, wherein the outer skin section of the first jamb assembly is provided on a surface thereof with a groove coupled with the hinge, and wherein the outer skin section of the third jamb assembly is provided on a surface thereof with a coupling hole coupled with the hinge.

* * * * *